US010903601B2

(12) United States Patent
Prot et al.

(10) Patent No.: US 10,903,601 B2
(45) Date of Patent: Jan. 26, 2021

(54) TEXTILE DEVICE CONFIGURED TO COOPERATE WITH AN ELECTRONIC DEVICE AND ELECTRONIC DEVICE THEREOF

(71) Applicant: BIOSERENITY, Paris (FR)

(72) Inventors: Pierre Prot, Paris (FR); Pierre-Yves Frouin, Paris (FR)

(73) Assignee: BIOSERENITY, Paris (FR)

( * ) Notice: Subject to any disclaimer, the term of this patent is extended or adjusted under 35 U.S.C. 154(b) by 0 days.

(21) Appl. No.: 16/348,667

(22) PCT Filed: Nov. 10, 2017

(86) PCT No.: PCT/FR2017/053073

§ 371 (c)(1),
(2) Date: May 9, 2019

(87) PCT Pub. No.: WO2018/087490

PCT Pub. Date: May 17, 2018

(65) Prior Publication Data

US 2019/0267756 A1 Aug. 29, 2019

(30) Foreign Application Priority Data

Nov. 10, 2016 (FR) ..... 16 60937
Nov. 9, 2017 (TW) ..... 106139077 A

(51) Int. Cl.
*H01R 13/62* (2006.01)
*H01R 12/78* (2011.01)
(Continued)

(52) U.S. Cl.
CPC ..... *H01R 13/6205* (2013.01); *H01R 12/77* (2013.01); *H01R 12/78* (2013.01); *H01R 13/631* (2013.01); *H01R 12/57* (2013.01)

(58) Field of Classification Search
CPC .... G11B 5/17; H01R 13/6205; H01R 13/631; H01R 12/78; H01R 12/77; H01R 12/57
(Continued)

(56) References Cited

U.S. PATENT DOCUMENTS 2,673,898 A * 3/1954 Reichert ..... H04R 25/04 381/319
6,374,643 B2 * 4/2002 Orima ..... D02G 3/12 66/193
(Continued)

FOREIGN PATENT DOCUMENTS

CN 105810717 A 7/2016
DE 102 01 265 B4 3/2005
(Continued)

OTHER PUBLICATIONS

International Search Report dated Jan. 30, 2018 in corresponding International Application No. PCT/FR2017/053073; 4 pages.

*Primary Examiner* — Gary F Paumen
(74) *Attorney, Agent, or Firm* — Maier & Maier, PLLC

(57) ABSTRACT

A textile device configured to cooperate with an electronic device including a first magnetic connection means, an electronic circuit including a connecting track, and a first positioning means; the textile device including: a textile including a conductive zone; a second magnetic connection means, connected to a first side of the textile, configured to cooperate with the first magnetic connection means to create a force of attraction with the first magnetic connection means; a second positioning means capable of cooperating with the first positioning means to position the textile device relative to the electronic device; wherein the positioning means of the textile device is arranged in so that the conductive area of the textile device is connected to the connection track of the electronic circuit on the second side
(Continued)

of the textile. Also, the corresponding electronic device and a system including the textile device and the electronic device.

11 Claims, 6 Drawing Sheets

(51) Int. Cl.
*H01R 13/631* (2006.01)
*H01R 12/77* (2011.01)
*H01R 12/57* (2011.01)

(58) Field of Classification Search
USPC ..... 439/37–39
See application file for complete search history.

(56) References Cited

U.S. PATENT DOCUMENTS

| | | | | |
|---|---|---|---|---|
| 7,637,747 | B2 * | 12/2009 | Jaatinen | A61B 5/0408 439/39 |
| 8,299,654 | B2 * | 10/2012 | Yamamoto | H01B 7/30 307/147 |
| 10,400,364 | B1 * | 9/2019 | Mayer | H01B 5/002 |
| 10,458,050 | B2 * | 10/2019 | Van Keymeulen | H01R 4/58 |
| 10,519,575 | B2 * | 12/2019 | Thompson | D03D 13/00 |
| 10,591,273 | B2 * | 3/2020 | Veca | B60N 2/797 |

FOREIGN PATENT DOCUMENTS

| | | | |
|---|---|---|---|
| DE | 202009005706 | U1 | 7/2009 |
| DE | 102014007849 | A1 | 11/2015 |
| EP | 1 815 788 | A1 | 8/2007 |

* cited by examiner

TEXTILE DEVICE CONFIGURED TO COOPERATE WITH AN ELECTRONIC DEVICE AND ELECTRONIC DEVICE THEREOF

FIELD OF INVENTION

The present invention relates to the field of smart clothing and electronic circuit connection systems to the textile of smart clothing.

BACKGROUND OF INVENTION

Smart clothing and textiles require the integration of electronics on media compatible with textile constraints. To withstand these constraints, the electronic equipment must be flexible, waterproof, and must not have a thickness that is too great and which may hinder the user. The electronics must also be able to withstand all the stresses experienced by the textile or clothing in its daily use (handling, washing, drying, folding . . . ).

Smart clothing often involves shipping electronic circuits. The electronic circuits comprise a set of electronic components often interconnected by means of a printed circuit. Electronic circuit technology has been developed for many years to become a mature technology, with reasonable cost, effective quality control, and an ability to integrate a high number of components compared to other technologies such as systems. on chips (SOC). Another advantage in the use of electronic circuits is their interchangeability, for example, after the deterioration of a garment.

It is therefore necessary to find a way to connect the electronic circuit to the textile. Several alternatives exist but still have many disadvantages. In particular, most existing connections involve a large thickness, protruding parts that hang other clothes during washing, difficulties in positioning and insertion by the user or the presence of cables or exposed wires.

There is first of all the possibility of connecting the conductive threads of the textile to the tracks of the electronic circuit by welding in order to connect the conductive zone of the textile to the electronic circuit. This method makes it possible to limit both the size and the mass of the devices connected to the textile. However, the process of welding each component to each wire or conductive part of the textile is long and difficult to automate. In addition, this method tends to concentrate the stresses at the axis of the weld and increases the risk of breaking the conductive thread of the welded textile.

A method of installing clasps for connecting the electronic device and the textile is also known. The clasp is thus detachably connected, on one side to the textile, on the other to the electronic circuit. However, the connection is only made on one or more points; which makes the connection fragile in case of constraints on one end of the device and makes the connection unstable. In addition, the rigidity inherent in such a method can provide discomfort for the user and further weaken the connection.

There is also the possibility of mounting an electronic circuit directly on the textile, and sewing metal wires to the interconnection with the electronic circuit (C. Kallmayer, T. Linz, R. Aschenbrenner, and H. Reichl. for smart textiles, mst news, 2: 42-43, 2005.). This technique, however, seems difficult to achieve on an industrial scale and does not allow the replacement of the electronic circuit, or conversely, the detachment of the flexible electronic circuit to connect to another textile.

Patent DE10201265 describes an electrical connection between two electronic modules separated by a textile insulating layer. These modules are attached to each other by a pair of magnets. These magnets are capable of transmitting a signal between the two modules thus allowing these modules to be electrically connected despite the presence of a non-conductive textile layer. However, this technical solution has the disadvantage of having to incorporate many components, including a conductive layer in addition to the insulating layer. In addition, the fastening means used do not allow precise positioning of the electronic module on the textile.

The present invention therefore aims to develop a new system comprising an electronic circuit for electrical and mechanical connection to a conductive area of an effective textile and able to withstand the stresses that the textile or garment can be subjected to in its daily use. The electronic device according to the present invention must be able to fix and detach from the textile without the implementation of complex operations. The device according to the present invention must also be able to be worn by the user of the textile without any discomfort.

SUMMARY

This invention relates to a textile device configured to cooperate with an electronic device comprising at least a first magnetic connection means, an electronic circuit comprising at least one connecting track, and at least one first positioning means; said textile device comprising:

- a textile comprising at least one conductive zone;
- at least one second positioning means capable of cooperating with the at least one first positioning means of the electronic device so as to position the textile device relative to the electronic device.

The at least one positioning means of the textile device is arranged in such a way that the at least one conductive area of the textile device is connected to at least one connection track of the electronic circuit on the second side of the textile.

According to one embodiment, the device comprises a damping layer positioned between the textile and the at least one second magnetic connection means.

According to one embodiment, the at least one conductive zone of the textile is made by weaving or knitting conductive yarns, said conductive yarns consist of a conductive material or textile yarns covered with a conductive material, preferably by weaving or knitting of wire covered with conductive metal such as silver.

According to one embodiment, the at least one conductive zone of the textile is made by by printing conductive ink or conductive paint.

According to one embodiment, the textile comprises multiple conductive zones separated by at least one insolating zone.

According to one embodiment, the electronic circuit comprises a flexible printed circuit.

The present invention further relates to an electronic device configured to cooperate with a textile device according to anyone of the embodiment hereabove; said electronic device comprising:

- an electronic circuit comprising at least one connection track;
- at least one first magnetic connection means, connected to the electronic circuit on the side opposite to the at least one connection track of the electronic circuit, configured to cooperate with the at least one second magnetic connection means of the textile device so as to create a force of attraction between the at least first and second magnetic connection means.

The at least one first positioning means of the electronic device is arranged such that the at least one connection track of the electronic device is connected to at least one conductive area of the textile device.

The present invention also relates to a system comprising a textile device according to anyone of the embodiment hereabove and an electronic device according to the embodiment hereabove.

According to one embodiment, in the system the at least one first magnetic connection means and the at least one second magnetic connection means are two permanent magnets or a permanent magnet and a ferromagnetic plate.

According to one embodiment, in the system the at least one first magnetic connection means and/or the at least one second magnetic connection means is covered by overmolding, said overmolding being preferably made of elastomer.

According to one embodiment, in the system the at least one first positioning means of the electronic device is a female means and the at least one second positioning means of the textile device is a male means passing through the textile.

According to one embodiment, in the system the at least one first positioning means of the electronic device is a male means passing through the textile and the at least one second positioning means of the textile device is a female means.

DETAILED DESCRIPTION

Figure 1:
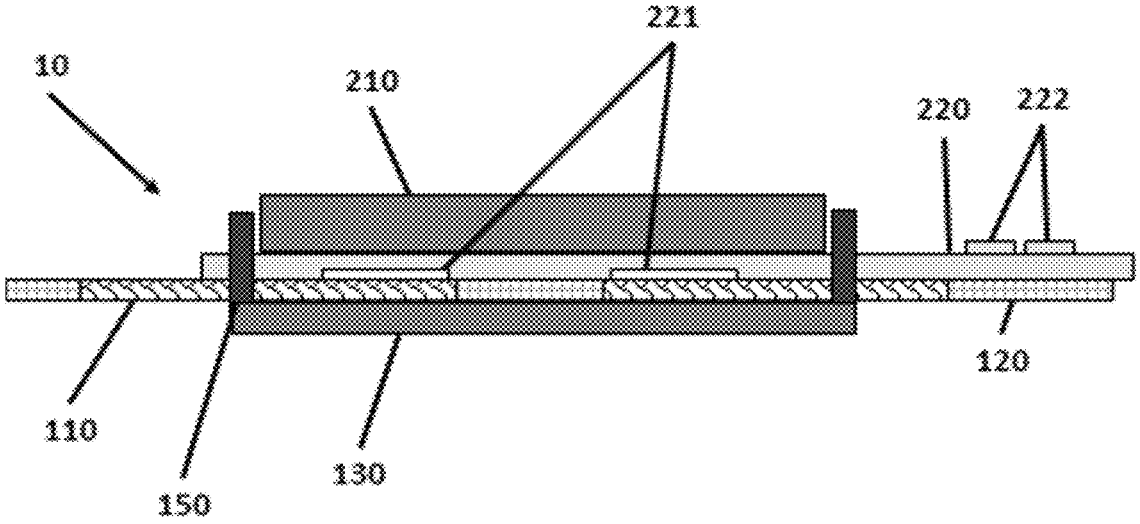
FIG. 1 is a sectional view along the axis A of FIG. 4 of the system 10 according to one embodiment of the present invention.

In the present invention, the following terms have the following meanings:

"Textile" refers to a material obtained by assembling yarns, fibers and/or filaments by any method such as, for example, weaving, or knitting "Smart clothing": refers to any textile capable of being worn by a subject comprising at least one conductive zone configured to transmit or receive an electrical signal.

One aspect of the present invention relates to a textile device capable of receiving an electronic device comprising an electronic circuit. Another aspect of the present invention relates to an electronic device adapted to be received by a textile device.

According to one embodiment, the textile device according to the present invention is configured to cooperate with an electronic device comprising at least a first magnetic connection means, an electronic circuit comprising at least one connecting track, and at least one first positioning means.

According to one embodiment, the textile device comprises a textile comprising at least one conductive zone. According to one embodiment, the textile device comprises at least a second magnetic connection means.

This magnetic connection means is in contact with a first face of the textile so as to create an attractive force with the first magnetic connection means of the electronic device. According to one embodiment, the textile device also comprises at least a second positioning means adapted to cooperate with the at least first positioning means of the electronic device so as to position the textile device relative to the electronic device. According to one embodiment, the positioning means of the textile device are arranged in such a way that the at least one conductive zone of the textile device is connected to at least one connection track of the electronic circuit on the side of the second face of the textile. Finally, the at least one second magnetic connection means of the textile device is positioned to connect at least a portion of the at least one conductive area of the textile device to the electronic device.

Textile is a material obtained by a thread assembly. In one embodiment, the textile comprises one or more conductive zones. The use of a textile comprising conductive zones makes it possible to produce smart clothes which are compact and easy to wear because all conductive tracks have been integrated into the textile itself.

In one embodiment, this conductive zone can be obtained by the presence in the textile of conductive yarns by weaving or knitting.

In one embodiment, the conductive wires consist of a conductive material such as silver.

In an alternative embodiment, the conductive yarns consist of textile yarns coated with a conductive material, preferably textile yarns coated with a conductive metal, most preferably textile yarns covered with silver.

In another embodiment, the conductive zone is obtained by printing a conductive ink or a conductive paint. Said conductive ink or conductive paint is loaded with an electrically conductive material, having properties of flexibility allowing it to be deposited on flexible surfaces.

Figure 4:
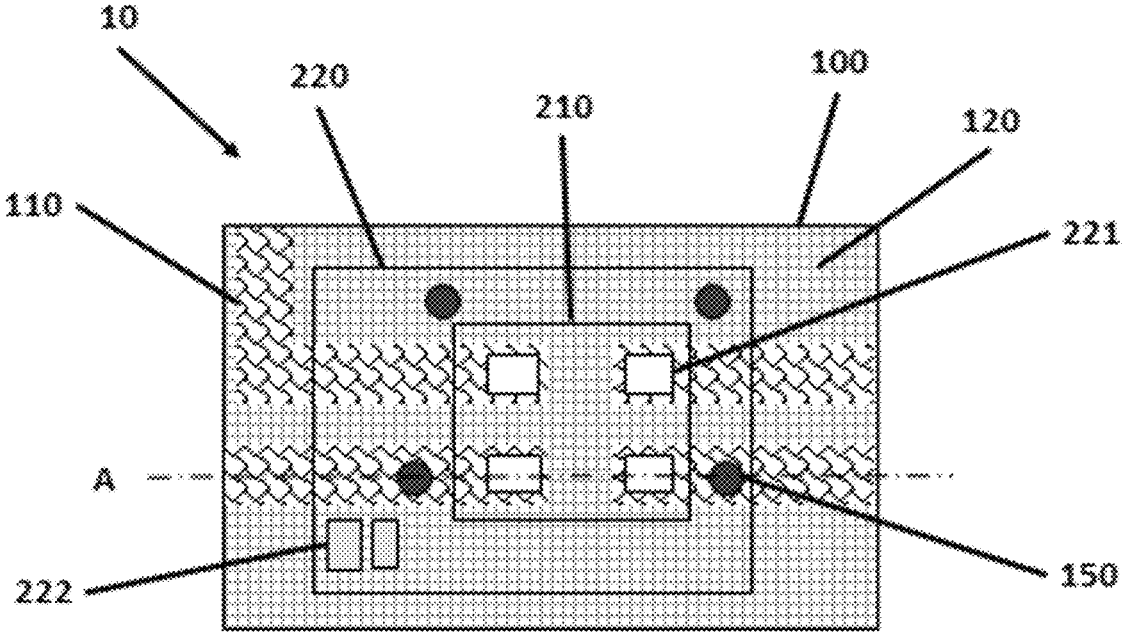
FIG. 4 is a view from above of the system 10 according to an embodiment of the present invention; the first magnetic connection means 210 and the textile electronic circuit 220 are represented as transparent.

In one embodiment, the textile comprises a plurality of conductive zones separated from one another by one or more insulating zones, to reduce the electronic noise. As illustrated in FIG. 4, these conductive zones 110 and insulating zones 120 thus create conductive paths in the textile.

The electronic device comprises an electronic circuit. In one embodiment, the electronic circuit is a flexible electronic circuit, in particular a flexible printed circuit. A flexible printed circuit, thanks to its flexibility, allow manufacturing garment more comfortable than with a rigid electronic circuit.

A flexible electronic circuit is a technology well known to those skilled in the art, which consists of using a high-performance plastic substrate, such as polyamide. The flexible electronic circuit is therefore an electrical and mechanical support of electronic components. It is made on a flexible support of the polyamide, polyetheretherketone (PEEK), polyester (PE) or other type. This flexible support makes it possible to fold the electronic device or to deform it without breaking the flexible electronic circuit.

It can also be performed on a rigid support of epoxy resin type reinforced with glass fibers (FR-4), or other.

The electronic circuit is an electrical and mechanical support for electronic components.

Flexible electronic circuits are well known by those skilled in the art and used in a wide variety of applications.

In another embodiment, the electronic circuit is not flexible but has a surface and a volume configured not to compromise the flexibility of the device according to the present invention.

The electronic circuit is electrically connected to the textile and is capable of recording or analyzing a signal from the textile. The electronic circuit is also able to respond to a signal or transmit a signal.

Figure 2:
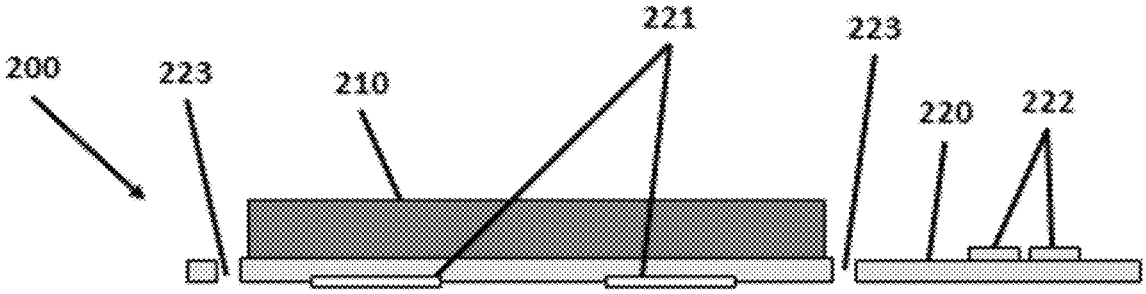
FIG. 2 is a sectional view along the axis A of FIG. 4 of the electronic device 200 according to one embodiment of the present invention.

In one embodiment, illustrated in FIG. 2, the components 222, performing electronic functions, are supported by the printed circuit of the electronic circuit 220. In one embodiment, these electronic components 222 are soldered to the printed circuit of the electronic circuit. In one embodiment, the electronic circuit 220 comprises layers of conductive materials, preferably copper coated with nickel and/or gold to prevent oxidation, so as to obtain conductive tracks. These tracks electrically connect different areas of the electronic circuit, either component-component or component to at least one connection track 221 which is an entry point of the flexible electronic circuit. In an embodiment not shown, the electronic circuit 220 is covered with a layer of varnish that protects the tracks from oxidation and possible short circuits.

In one embodiment, the electronic device is equipped with rigid reinforcements for stiffening certain areas under the electronic components whose welding process is incompatible with the flexible electronic circuits. In this embodiment, the electronic circuit is a succession of rigid zones articulated together by flexible zones.

The electronic circuit therefore comprises at least one connection track. As illustrated in FIG. 1, the magnetic connection means 130, 210 and the positioning means 150, 223 are configured so that the at least one conductive zone of the textile 110 is in contact with at least one connection track 221 of the circuit 220. This contact allows the electrical connection between the textile device 100 and the electronic device 200.

The textile device and the electronic device both comprise at least one magnetic connection means. The advantage of using magnetic connection means is to be able to fix and detach the electronic device of the textile without the implementation of complex operations. In addition, the mechanical connection by means of magnetic connection means has the advantage of ensuring an effective electrical connection between the conductive areas of the electrical device and those of the textile which is able to withstand the stresses that the textile or clothing may be caused to undergo in its daily use.

As illustrated in FIG. 2, the at least one first magnetic connection means 210 of the electronic device 200 is in contact with the electronic circuit 220 on the opposite side of the at least one connection track 221 of the electronic circuit 220. In one embodiment, the first magnetic connection means 210 is fixed to the electronic circuit 220 by any means known to those skilled in the art, such as an adhesive, for example a heat-sealing adhesive.

Figure 5:
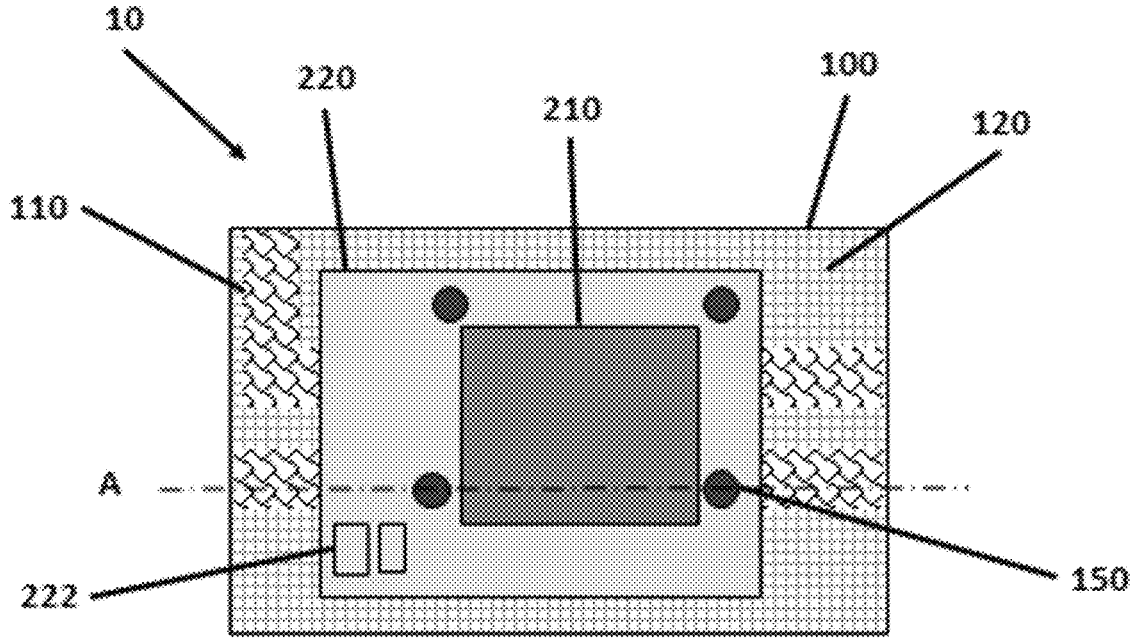
FIG. 5 is a top view of the system 10 according to an embodiment of the present invention.
Figure 6:
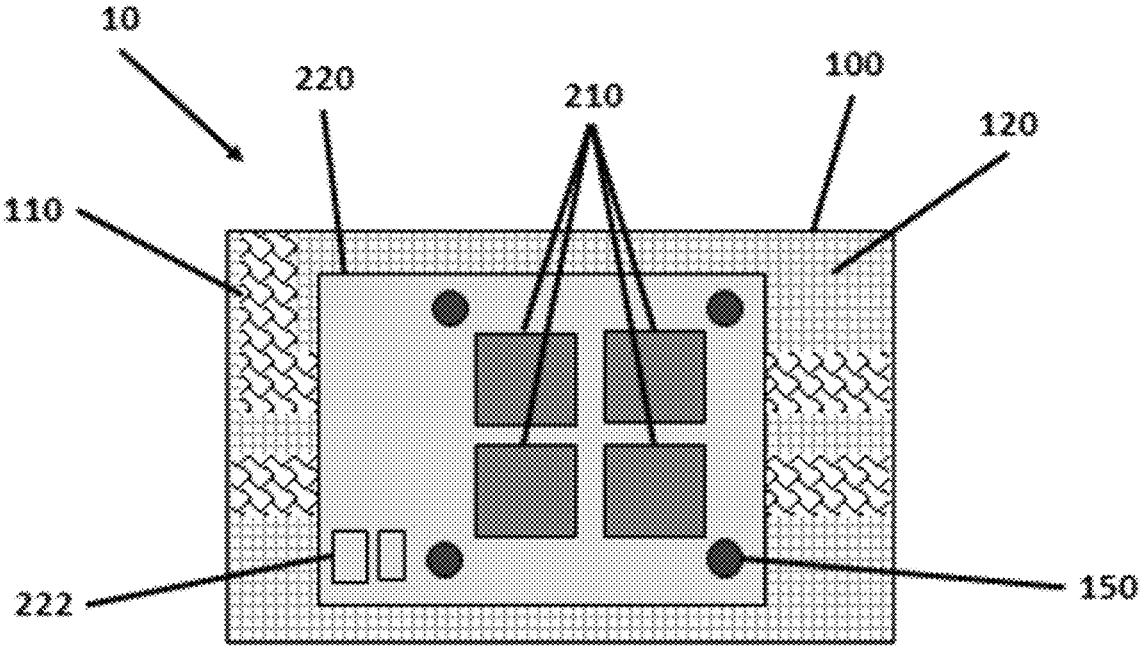
FIG. 6 is a top view of the system 10 according to an embodiment of the present invention wherein the system comprises a plurality of first magnetic connection means 210.
Figure 7:
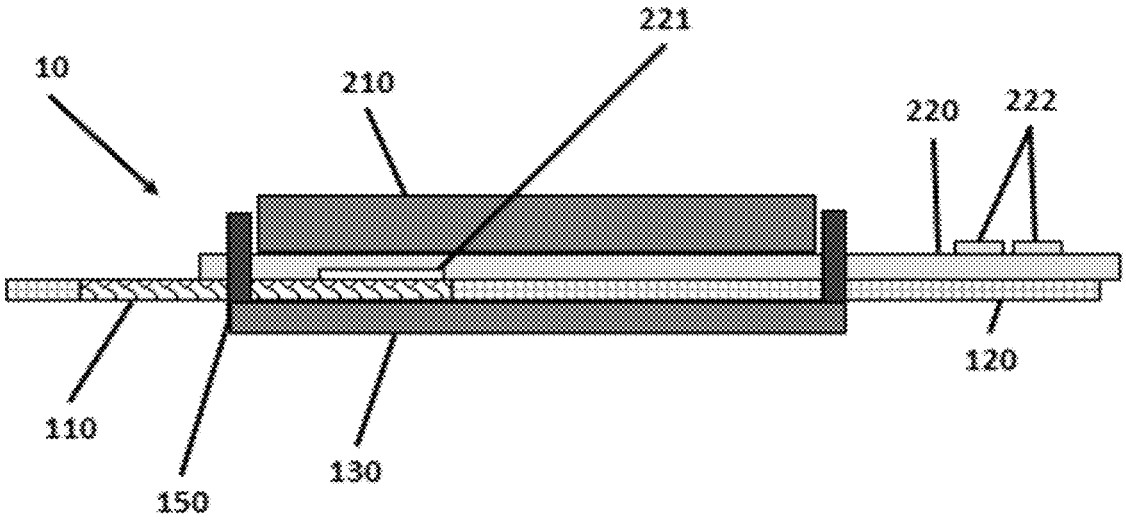
FIG. 7 is a sectional view along the axis A of FIG. 10 of the system 10 according to an embodiment of the present invention wherein the system comprises only one conductive zone 110 and a single connection track 221.
Figure 8:
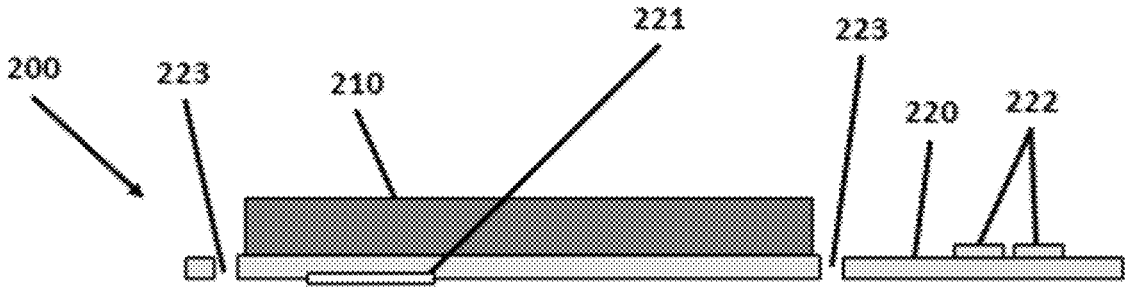
FIG. 8 is a sectional view along the axis A of FIG. 10 of the electronic device 200 according to one embodiment of the present invention in which the electronic device 200 comprises only one connection track 221.
Figure 9:
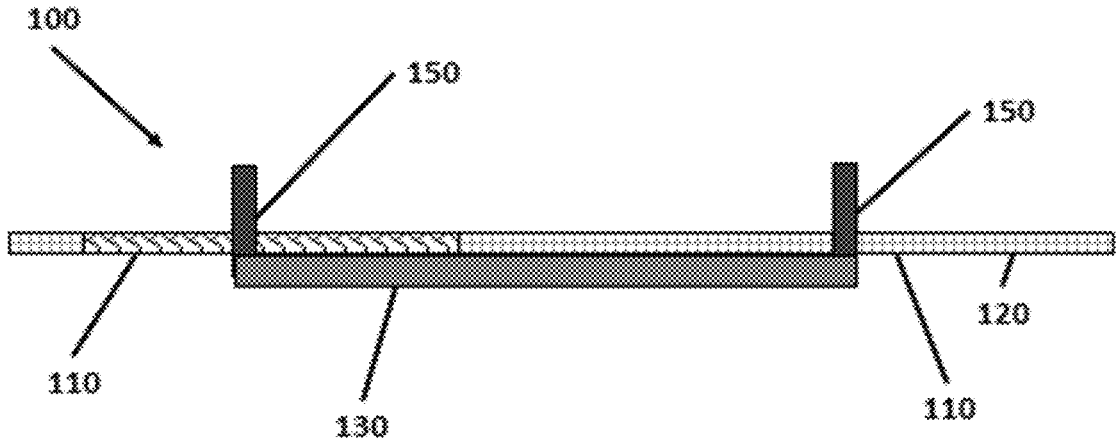
FIG. 9 is a sectional view along the axis A of FIG. 10 of the textile device 100 according to one embodiment of the present invention wherein the textile comprises only one conductive zone 110.
Figure 10:
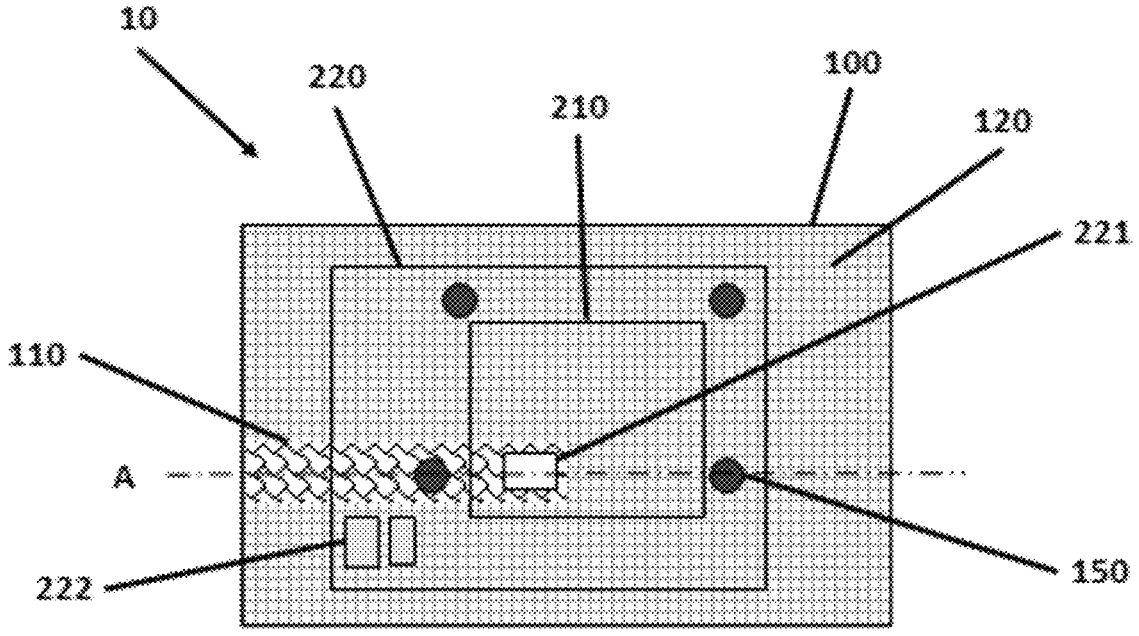
FIG. 10 is a top view of the system 10 according to an embodiment of the present invention wherein the system comprises only one conductive zone 110 and only one connection track 221.

In an embodiment illustrated in FIGS. 4 and 5, the electronic device 200 comprises a single first magnetic connection means 210. In an alternative embodiment illustrated in FIG. 6, the electronic device 200 comprises several first magnetic connection means 210. In another embodiment, there are as many magnetic connection means 210 as connection tracks 221 and each first magnetic connection means 210 is arranged to apply an attractive force to the at least one second magnetic connection means 130 at the location of each connection track 221.

Figure 3:
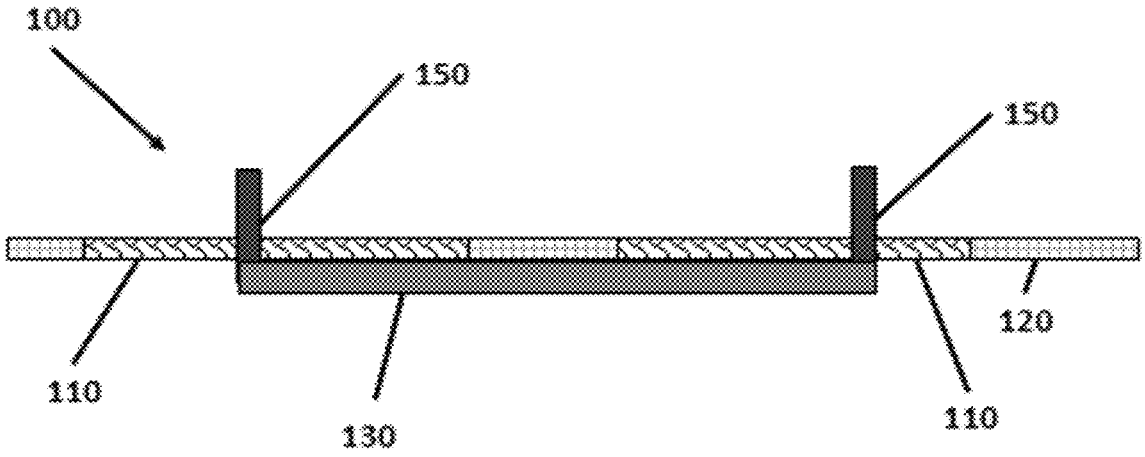
FIG. 3 is a sectional view along the axis A of FIG. 4 of the textile device 100 according to one embodiment of the present invention.

In an embodiment as illustrated in FIG. 3, the at least one second magnetic connection means 130 of the textile device 100 is in contact with the face of the textile that is not brought into contact with the electronic device 200. Said at least one second magnetic connection means 130 is adapted to cooperate with the at least one first magnetic connection means 210 of the electronic device so as to create an attractive force with the first magnetic connection means of the electronic device. The at least one second magnetic connection means 130 is in contact with a portion of the conductive zone of the textile 110 either directly or via any other means. In one embodiment, the at least one second magnetic connection means 130 and the textile are fixed by any means known to those skilled in the art, such as an adhesive, for example a heat-sealing adhesive.

Figure 11:
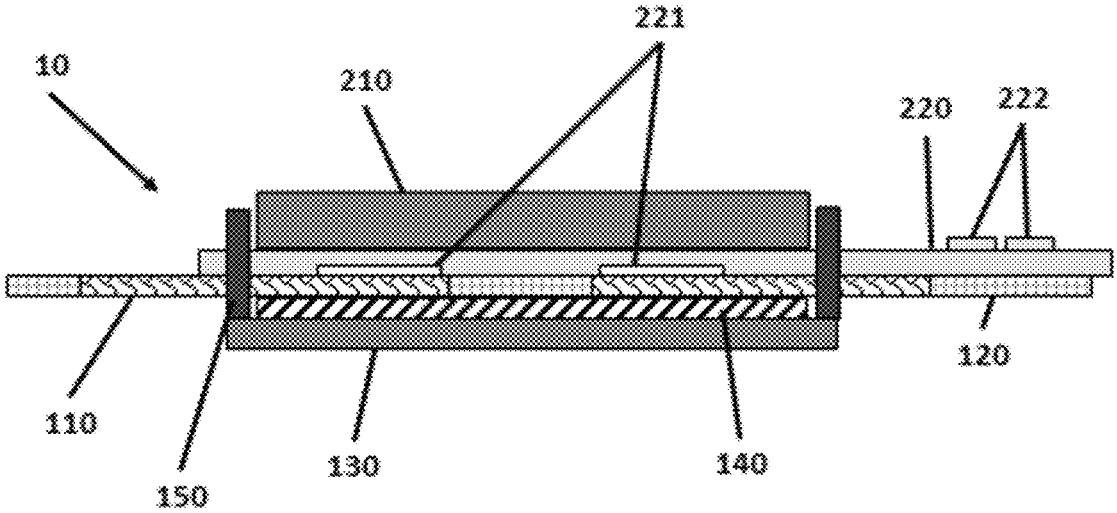
FIG. 11 is a sectional view along the axis A of FIG. 4 of the system 10 according to the embodiment of the present invention wherein the textile device comprises a damping layer 140.
Figure 12:
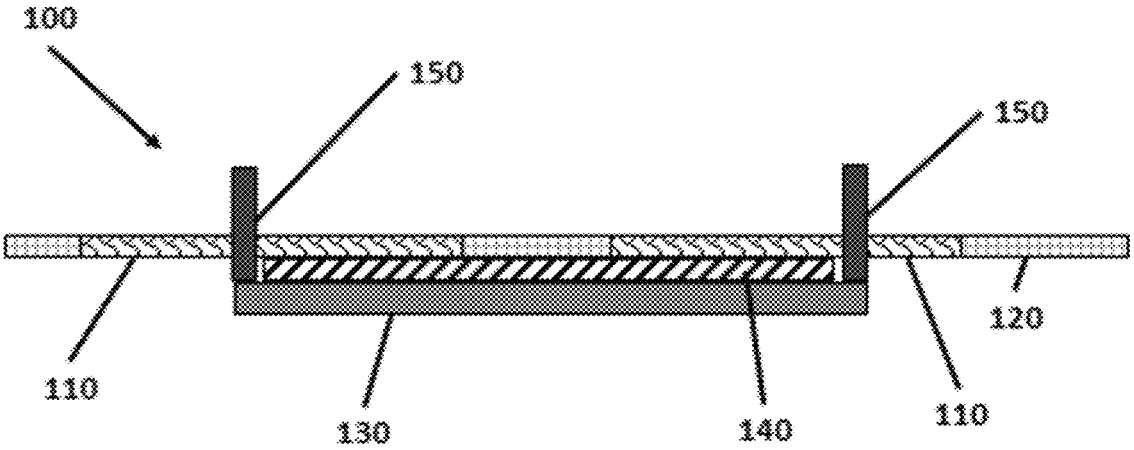
FIG. 12 is a sectional view along axis A of FIG. 4 of the textile device 100 according to the embodiment of the present invention in which the textile device 100 comprises a damping layer 140.

In one embodiment, illustrated in FIGS. 11 and 12, the at least one second magnetic connection means 130 is in contact with a portion of the conductive zone of the textile 110 via a damping layer 140. In an embodiment wherein the at least one second magnetic connection means 130 is in contact with a portion of the conductive zone of the textile 110 through a damping layer 140, the second magnetic means 130 and the damping layer 140 are fixed by an adhesive or by an adhesive method such as overmolding a silicone on a metal part.

In one embodiment as illustrated in FIG. 1, the at least one first magnetic connection means 210 and the at least one second magnetic connection means 130 are configured so as to be placed one in front of the other and therefore be attracted to each other by a force of magnetic attraction. According to this embodiment, the at least one first magnetic connection means 210 and the at least one second magnetic connection means 130 are arranged so as to be separated, at least via the electronic circuit 220, from at least one connecting track 221, of at least one conductive zone of the textile 110. The at least one first magnetic connection means 210 and the at least one second magnetic connection means 130 are arranged to exert a pulling force at least on the electronic circuit 220, on the at least one connecting track 221, and on the at least one conductive area of the textile 110.

In one embodiment, the magnetic connection means 130 and 210 are located on either side of the connection track or tracks so as to ensure optimum electrical contact between the connection track(s) and the textile conducting zone(s).

In one embodiment, the magnetic connection means 130 and 210 are permanent magnets. In an alternative embodiment, the magnetic connection means 130 and 210 are a permanent magnet and a ferromagnetic plate. In one embodiment, the at least one first magnetic connection means 210 is a permanent magnet and the at least one second magnetic connection means 130 is a ferromagnetic plate. In an alternative embodiment, the at least one second magnetic connection means 130 is a permanent magnet and the at least one first magnetic connection means 210 is a ferromagnetic plate.

In one embodiment, the force of the magnetic connection means 130 and 210 is sufficient to secure the textile device 100 and the electronic device 200, but allows the user to separate the two devices if necessary.

In one embodiment, the at least one first magnetic connection means 210 and the at least one second magnetic connection means 130 have the same thickness. In one embodiment, the at least one first magnetic connection means 210 has a thickness greater than that of the at least one second magnetic connection means 130.

In one embodiment, the second positioning means 150 is diamagnetic. According to this embodiment, the second positioning means 150 is made by one or more diamagnetic materials. In an alternative embodiment, the second positioning means 150 is ferromagnetic.

The electronic device comprises at least a first positioning means 223.

The textile device 100 also comprises at least a second positioning means 150 adapted to cooperate with the at least one first positioning means 223 of the electronic device 200 so as to position the textile device 100 relative to the electronic device 200. The at least one first positioning means 223 of the electronic device 200 is arranged in such a way that the at least one connection track 221 of the electronic device 200 is connected to at least one conductive zone 110 of the textile device 100 when it co-operates with the at least one second positioning means 150 of the textile device 100.

The at least one first positioning means 223 and at least one second positioning means 150 cooperate with one another so as to prevent the electronic device 200 from moving relative to the textile device 100 in parallel with the textile.

In one embodiment, the positioning means 223 and 150 are means of the "male" and "female" type.

In one embodiment, the at least one first positioning means 223 of the electronic device is a female means and the at least one second positioning means 150 of the textile device is a male means passing through the textile. In this embodiment, the at least one first positioning means 223 is a bore or an opening. In this embodiment, the at least one second positioning means 150 is a positioning pin. Said at least one positioning pin passes through the textile.

In an alternative embodiment, the at least one second positioning means 150 of the textile device is a female means and the at least one first positioning means 223 of the electronic device is a male means.

In one embodiment, the female means are holes and the male means are locating pegs or rods and the diameter of the male means is substantially the same as that of the female means so that there is no game when the male and female means are assembled. These positioning means, however, do not prevent the withdrawal of the electronic device 200 from the textile device 100 when the textile device 200 is separated by a force perpendicular to the textile device 200.

In one embodiment, there is the same number of first positioning means 223 as second positioning means 150.

In one embodiment in which the system comprises several first positioning means, the first positioning means 223 are arranged on either side of the connecting tracks 221.

In one embodiment, the at least one first 223 and at least one second 150 positioning means are not positioned so as to pass through the connection tracks 221.

In one embodiment, the at least one first positioning means 223 is a through hole located on the electronic circuit 220. In one embodiment, the at least one second positioning means 150 is a locating peg protruding from the second magnetic connection means 130.

In a particular embodiment illustrated in FIG. 12, the textile device 100 comprises a damping layer 140 between the textile and the at least one second magnetic connection means 130. This damping layer makes it possible to provide a support force to the contact between the at least one conductive zone of the textile 110 and the at least one connection track 221. The damping layer 140 also makes it possible to distribute the stresses to which the electronic circuit 220 and the textile are subjected, caused by the attraction of the at least one first magnetic connection means 210 and at least one second magnetic connection means 130. The system comprising an electronic device 200 and a textile device 100 according to this embodiment is illustrated in FIG. 11.

In an alternative embodiment, when the textile 110, 120 is thick and flexible, it acts as a damping layer.

In one embodiment, the damping layer 140 is a flexible or elastic layer.

In one embodiment, the damping layer 140 is made of elastomer, of synthetic foams (for example polyurethane foam), or of any other flexible material preformed so as not to be flat and to increase its compressibility.

In an embodiment not shown, the at least one first magnetic connection means 210 and/or the at least one second magnetic connection means 130 is covered by an overmoulding.

The overmoulding makes it possible to give the user grip comfort.

In one embodiment, the overmolding is made of flexible polymer. In one embodiment overmolding is made of elastomer or plastic.

In one embodiment, the electronic device 200 has a flexibility such that it can be bent over a cylindrical piece having a radius of 5 to 10 cm.

In one embodiment, the electronic device 200 has a thickness between 100 and 500 microns to ensure the flexibility and strength of the assembly. Depending on the thickness of the components and the electronic circuit 220, the total thickness of the device is between 1 and 5 mm.

The invention also relates to a system 10 comprising the electronic device 200 and the textile device 100 cooperating with each other.

As illustrated in FIG. 1, the invention therefore relates to a system 10 comprising a textile device 100 and an electronic device 200; said textile device comprising:

a textile comprising at least one conductive zone 110;

at least one second magnetic connection means 130 in contact with a first face of the textile; and at least one second positioning means 150;

said electronic device 200 comprising:

an electronic circuit 220 comprising at least one connection track 221;

at least one first positioning means 223; and at least one first magnetic connection means 210;

wherein the at least one first positioning means 223 is adapted to cooperate with the at least one second positioning means 150 so as to position the electronic device 200 relative to the textile device 100 and so that the at least one conductive area the textile device 110 is connected to at least one connecting track 221 of the electronic circuit 220; and the at least one first magnetic connection means 210 is adapted to cooperate with the at least one second magnetic connection means 130 so as to create a force of attraction between the at least first and second magnetic connection means.

In an embodiment illustrated in FIGS. 7 to 10, the electronic device 200 comprises only one connecting track 221, the textile of the textile device 100 comprises only one conductive zone 110, and the system 10 comprises only one conductive zone 110 and only one connection track 221.

In the system 10 according to the present invention, the electronic device 200 is easily detachable from the textile device 100 by the user simply by applying a force greater than the attractive force of the magnetic connection means 130 and 210. The connection is also simple and fast since it is sufficient to put the electronic device 200 on the textile device 100 so as to match the positioning means 223 and 150, the attractive force of the magnetic connection means 130 and 210 thus fixes the two devices to each other.

These advantages allow a smart garment to perform measurements continuously over long periods of time (from several days). When the patient changes clothes, he can then remove the electronic device 200 from his old garment and put it on a new garment, without the help of a technician. The patient is therefore autonomous and can perform this kind of measure without modifying his daily activity.

The invention claimed is:

1. A textile device configured to cooperate with an electronic device comprising at least a first magnetic connection means, an electronic circuit comprising at least one connecting track, and at least one first positioning means; said textile device comprising:

a textile comprising at least one conductive zone;

at least one second magnetic connection means, connected to a first side of the textile, configured to cooperate with the at least one first magnetic connection means of the electronic device so as to create a force of attraction with the at least one first magnetic connection means of the electronic device; and at least one second positioning means capable of cooperating with the at least one first positioning means of the electronic device so as to position the textile device relative to the electronic device;

wherein the at least one second positioning means of the textile device is arranged in such a way that the at least one conductive zone of the textile device is connected to at least one connection track of the electronic circuit on the second side of the textile; and wherein the at least one conductive zone of the textile is made by weaving or knitting conductive yarns, said conductive yarns consist of a conductive material or textile yarns covered with a conductive material.

2. The textile device according to claim 1, wherein the device comprises a damping layer positioned between the textile and the at least one second magnetic connection means so as to distribute the stresses to which the electronic circuit and the textile are subjected.

3. The textile device according to claim 1, wherein the at least one conductive zone of the textile is made by weaving or knitting of yarn covered with conductive metal, or by printing conductive ink or conductive paint.

4. An electronic device configured to cooperate with a textile device according to claim 1, said electronic device comprising:

an electronic circuit comprising at least one connection track;

at least one first positioning means capable of cooperating with the at least one second positioning means of the textile device so as to position the electronic device relative to the textile device; and at least one first magnetic connection means, connected to the electronic circuit on the side opposite to the at least one connection track of the electronic circuit, configured to cooperate with the at least one second magnetic connection means of the textile device so as to create a force of attraction between the at least first magnetic connection means and second magnetic connection means;

wherein the at least one first positioning means of the electronic device is arranged such that the at least one connection track of the electronic device is connected to at least one conductive zone of the textile device.

5. A system comprising a textile device according to claim 1 and an electronic device configured to cooperate with the textile device, said electronic device comprising:

an electronic circuit comprising at least one connection track;

at least one first positioning means capable of cooperating with the at least one second positioning means of the textile device so as to position the electronic device relative to the textile device; and at least one first magnetic connection means, connected to the electronic circuit on the side opposite to the at least one connection track of the electronic circuit, configured to cooperate with the at least one second magnetic connection means of the textile device so as to create a force of attraction between the at least first magnetic connection means and second magnetic connection means;

wherein the at least one first positioning means of the electronic device is arranged such that the at least one connection track of the electronic device is connected to at least one conductive zone of the textile device.

6. The system according to claim 5, wherein the at least one first magnetic connection means and the at least one second magnetic connection means are two permanent magnets or a permanent magnet and a ferromagnetic plate.

7. The system according to claim 5, wherein the at least one first magnetic connection means and/or the at least one second magnetic connection means is covered by overmolding.

8. The system according to claim 7, wherein the overmolding is made of elastomer.

9. The system according to claim 5, wherein the at least one first positioning means of the electronic device is a female means and the at least one second positioning means of the textile device is a male means passing through the textile.

10. The system according to claim 5, wherein the at least one first positioning means of the electronic device is a male means passing through the textile and the at least one second positioning means of the textile device is a female means.

11. The electronic device according to claim 4, wherein the electronic circuit comprises a flexible printed circuit.

* * * * *